10/15/85 XF 4,546,559

United States Patent [19]

Dassler

[11] Patent Number: 4,546,559

[45] Date of Patent: Oct. 15, 1985

[54] ATHLETIC SHOE FOR TRACK AND FIELD USE

[75] Inventor: Armin A. Dassler, Herzogenaurach, Fed. Rep. of Germany

[73] Assignee: Puma-Sportschuhfabriken Rudolf Dassler KG, Fed. Rep. of Germany

[21] Appl. No.: 523,791

[22] Filed: Aug. 16, 1983

[30] Foreign Application Priority Data

Sep. 11, 1982 [DE] Fed. Rep. of Germany ..... 3233792

[51] Int. Cl.[4] ..... A43B 5/06; A43B 13/16

[52] U.S. Cl. ..... 36/129; 36/25 R; 36/31; 36/114

[58] Field of Search ..... 36/114, 129, 72 A, 59 C, 36/134, 32 R, 25 R, 30 R, 30 A, 31, 126, 127

[56] References Cited

U.S. PATENT DOCUMENTS

| | | | |
|---|---|---|---|
| 931,343 | 8/1909 | Riley | 36/134 |
| 1,392,704 | 10/1921 | Pierce | 36/129 |
| 4,079,526 | 3/1978 | Fukuoka | 36/30 R |
| 4,231,169 | 11/1980 | Toyama et al. | 12/146 S |
| 4,454,662 | 6/1984 | Stubblefield | 36/134 |

FOREIGN PATENT DOCUMENTS

| | | | |
|---|---|---|---|
| 295875 | 7/1915 | Fed. Rep. of Germany | 36/25 R |
| 2927635 | 1/1981 | Fed. Rep. of Germany | 36/128 |
| 1014462 | 8/1957 | Fed. Rep. of Germany | 36/129 |
| 2706645 | 8/1978 | Fed. Rep. of Germany | 36/114 |
| 2826968 | 1/1980 | Fed. Rep. of Germany | 36/126 |
| 1554061 | 1/1969 | France | 36/114 |
| 1101097 | 1/1968 | United Kingdom | 36/129 |
| 1423881 | 2/1976 | United Kingdom . | |

*Primary Examiner*—Werner H. Schroeder
*Assistant Examiner*—Steven N. Meyers
*Attorney, Agent, or Firm*—Sixbey, Friedman & Leedom

[57] ABSTRACT

An athletic shoe for track and field use, especially a running shoe, is formed in such a way that a flexible running sole is provided only in the area of its running surface and, thus, largely does not exist in the area of the longitudinal arch of the foot, and from the arch area to the heel, the running sole is rendered resistant to distortion by a reinforcement plate. Additionally, in the area of the longitudinal arch of the foot, the running sole has a supporting wall directed diagonally upward toward the inside of the foot that is fitted to the arch of the foot. Thus, a shoe for track and field use is obtained that is extremely light in weight, has high resistance to distortion and supports the foot well.

27 Claims, 4 Drawing Figures

ATHLETIC SHOE FOR TRACK AND FIELD USE

BACKGROUND AND SUMMARY OF THE INVENTION

This invention relates to an athletic shoe, especially a running shoe, for running and jumping competitions having a sole made of a flexible plastic with molded projections on its running surface.

Athletic shoes of the initially noted type for track and field purposes, especially for sprint and short distances, are generally known and described and shown, for example, in the brochure "PUMA-Sportschuhe 66," pages 8 and 9, under the title of "PUMA SF-Form". These running shoes, having the special sole form SF (super-form), are extremely light because the actual running sole is provided only in areas that constitute tread areas. In the areas of the arch of the foot, the comparatively thin material of the upper is fitted to the arch of the foot. In contrast to previous constructions, these shoes are very light because relatively large amounts of sole material is saved in the area of the sole. Because of the usually continuous rubber running sole, these running shoes are very elastic. The spikes projecting downward in the forefoot area are riveted into a midsole. Therefore, this area is not very elastic and, considered separately, quite heavy.

It is known, on the basis of DE-AS 1 014 462, to leave out the midsole and, in order to save weight, to arrange the plate provided for the fastening of the spikes between two plastic plates made, for example, of polyamide. The two plastic plates are disposed between the insole and the running sole. This construction is lighter than the previously used metal plates, but it is also very inelastic.

It was found that running shoes having a running sole that, in the area of the center of the foot, is very narrow, when extreme lightness is endeavored, are very soft and can, especially in this area, be distorted easily and are, therefore, not very dimensionally stable. When the running sole is made of a harder material, the flexibility will suffer, especially in the ball area, so that peak performances cannot be achieved and an anatomically favorable fit to the foot during the treading motion is not possible.

A primary object of the present invention is, therefore, to provide an athletic shoe for field and track use, especially a running shoe, which, while being as light as possible, is optimally fitted to the anatomical conditions of the foot during the run, and offers as little resistance as possible to the natural movements. On the other hand, a good guidance and support of the foot and, at the same time, a high resistance to distortion must also be guaranteed.

This objective is achieved, in accordance with a preferred embodiment of the invention, since the running shoe, in an area of the longitudinal arch of the foot, is placed toward the outside edge of the foot and is narrowed so that the outside edge of the foot, stressed during running, is still fully supported; the running sole is provided with a reinforcement plate extending from the heel, via the narrowed part of the sole, to at least approximately before the start of the ball of the foot and being fitted onto the running sole, and since the running sole, in the area of the longitudinal arch of the foot; forms a supporting wall that extends diagonally upwardly toward the inside of the foot and is substantially fitted to the arch contour of the longitudinal arch of the foot.

Because of the known shape of the running sole, material is saved for the running sole which results in the saving of weight. By means of the arrangement of the reinforcing plate in the area of the center of the foot, i.e., in the area of the arch of the foot, reaching to the heel, the required resistance to distortion is achieved, on the one hand. On the other hand, in this area, the reinforcing plate, as well as the running sole, may be developed to be very thin so that the sole, as a whole, is at least not thicker than the previously used sole constructions. Nevertheless, the desired resistance to distortion is achieved and the low weight of the shoe is maintained. Finally, by means of the supporting wall shaped on in the area of the joint, the arch of the foot is decisively supported, especially also in the moving phases, so that corresponding arch supports, known by themselves, may possibly be eliminated. In addition, this supporting wall also contributes to the fact that the resistance to distortion of the running sole is increased significantly.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
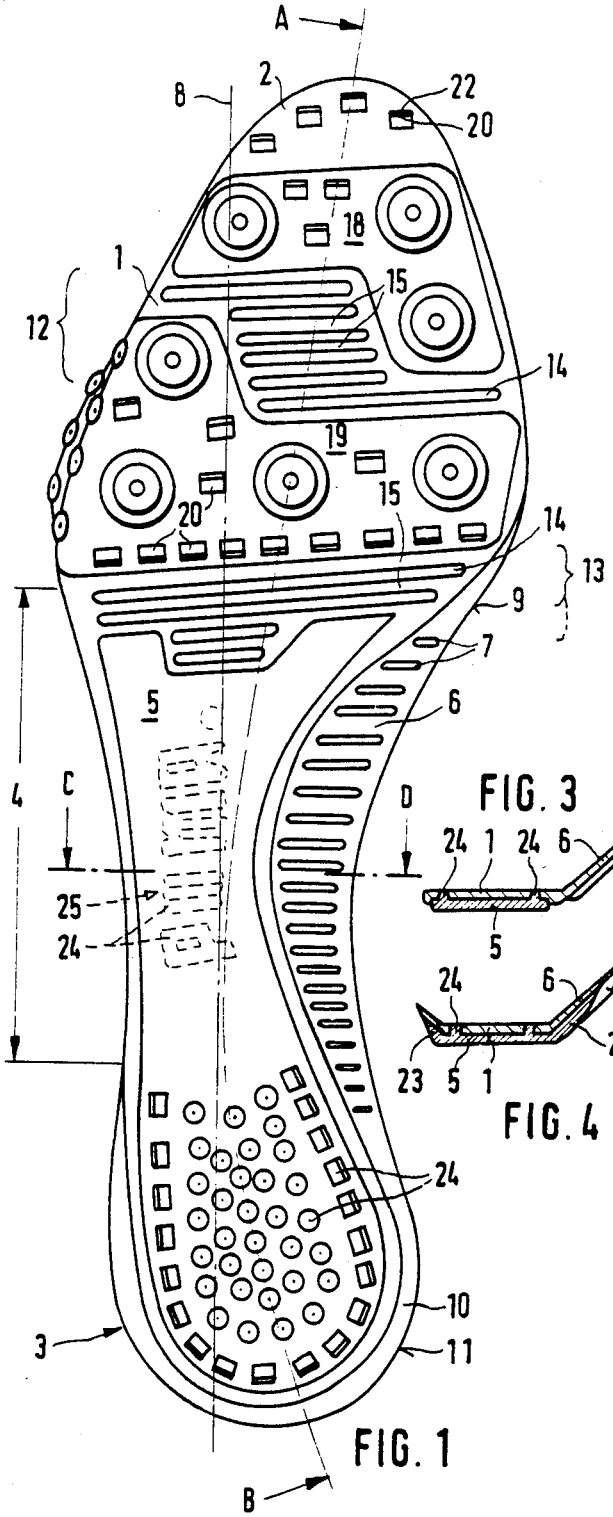
FIG. 1 is a bottom view of the running sole, i.e., of the running surface, for athletic shoes for track and field use, in accordance with a preferred embodiment of the invention.
Figure 2:
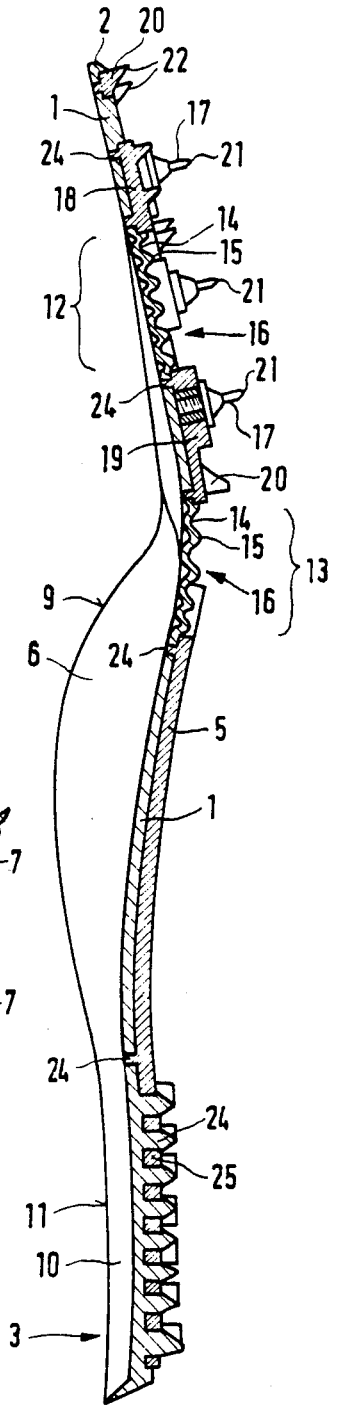
FIG. 2 is a cross-sectional view of the running sole of FIG. 1, taken along line A–B therein.
Figure 3:
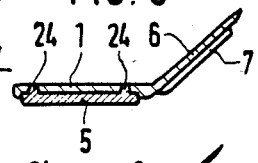
FIGS. 3 and 4 each show a cross-sectional view taken along line C–D of FIG. 1 of a respective form of reinforcement plate.

A running sole made of an elastic material, such as polyamide, polyurethane or polyethylene, has the reference number 1. This running sole 1 extends from the tip of the sole 2 to the heel 3. In the area 4 of the longitudinal arch of the foot, the sole is constructed, toward the outside edge of the foot, in such a way that no tread exists under the arch of the foot, the tread extending only over the part of the sole (the running surface) that engages the ground during the running. In this area 4, a reinforcement plate 5, made of a very hard, viscoplastic or springy plastic material, is provided, according to the invention, that continues into the heel 3. The reinforcement plate 5 is used mainly to produce a high resistance of the running sole 1 to distortion. The reinforcement plate 5, advantageously, consists of a suitably adapted polyamide, polyurethane or polyethylene. It is useful to mix the plastic with fillers that increase stability, especially with suitable fiber materials, such as fiberglass or glass fabrics. Fiberglass-reinforced polyamide and polyurethane has proven to be especially suitable since these materials guarantee a sufficient scuff resistance and stiffness at a low weight and price.

The hardness of the reinforcement plate 5 is advantageously at least 90 to 150 degrees of Shore hardness. However, the Shore hardness of the running sole 1 is selected to be lower and is preferably between 50 and 80. According to the invention, the running sole 1, in the area 4, is provided with a supporting wall 6, extending diagonally upward toward the inside, which is largely fitted to the arch of the foot. Thus, a joint support is obtained that has especially favorable effects during running and also significantly increases the resistance to distortion of the running sole 1. The supporting wall 6 is advantageously provided with reinforcing ridges 7. These reinforcing ridges 7 are preferably arranged so that, when one looks at the running sole 1 from below, they extend substantially normal to the longitudinal axis 8 of the sole 1. The distance between adjacent reinforcing ridges 7 is advantageously about 2 to 5 millimeters and the thickness and height of the ridges 7 is about 0.5 to 3 mm, preferably about 1 to 2 mm. The thickness of the supporting wall 6 is maximally about 2 mm, preferably about 1 mm, and advantageously decreases continuously in the direction toward the edge 9 so that, in cross section, a very acute angle is formed at the edge 9, and the edge 9 practically forms a cutting edge.

In an advantageous manner, the supporting wall 6 can continue into a shell-type border 10 surrounding the heel 3 so that the runner's heel is also guided well. The edge 11 of the shell-type border 10 may advantageously also be formed in a manner corresponding to the edge 9, i.e., tapering in thickness to the sharp edge.

Advantageously, the running sole 1, in the area of the toe joints and/or in the ball area, by means of bending zones 12 and 13, is made more flexible because of the fact that a corrugated band 16 is formed there, consisting of rippling valleys and elevations 14, 15, respectively, that extend, preferably, approximately normal to the longitudinal axis 8 of the sole. In the forefoot area of the running sole 1, insert pieces 18, 19 are preferably provided outside the bending zones 12, 13, or reaching around said bending zones 12, 13 no more than partially, with said insert pieces 18, 19 being used for reinforcement and advantageously for receiving insertable spikes 17. These insert pieces 18, 19 preferably consist of the same material as the reinforcement plate 5. Apart from the spike-type gripping elements 17, the insert pieces 18, 19 may also have profile projections 20 that are shaped onto them. The projections 20 are advantageously of such a height that tips 21 of the spikes 17 only slightly, i.e., about 1 to 4 mm, project above the tips 22 of the profile projections 20. The insert pieces 18, 19 may have L-shapes, in which case one of the sides is longer and extends at least approximately normal to the longitudinal axis 8 of the sole 1.

Figure 4:
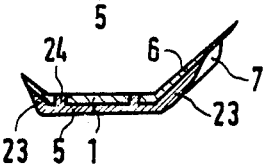

According to an advantageous further feature of the invention, the reinforcement plate 5, in order to further increase its resistance to distortion, may have a border 23 that is bent upward, at least in the area 4 of the supporting wall 6, or over the whole outside edge, as shown in FIG. 4. In cross section, this border 23 is tapered toward its edge so that it is, for example, shaped to correspond to the edges 9, 11.

Another advantageous feature of the invention is to provide the reinforcement plate 5 and the insert pieces 18, 19 with projections 24, for example, in the form of pegs or claws, and with openings 25, which, on the one hand, represent gripping elements; and, on the other hand, are used for anchoring these parts 5, 18, 19 to the running sole 1. The sole 1, therefore, also has corresponding projections and/or openings. If the running sole 1 and the reinforcement plate 5, and possibly the insert pieces 18, 19, are prefabricated separately, these anchorings fit or engage in one another, and these individual components are glued together over large areas, or are, for example, bonded ultrasonically. Advantageously, the reinforcement plate 5 and the insert pieces 18, 19, as prefabricated elements, are placed in a mold and the material of the running sole 1 is injection-molded around them, i.e., the running sole 1 is injection-molded onto these parts. The projections 24 of the running sole 1 are developed as profile projections for a better gripping of the track, as this is shown in the heel area 3. In the area 4 of the arch of the foot, the projections 24 of the running sole 1, that project through the openings 25, may have the shape of letters and/or numbers, and may, thus, be used to depict a trademark or model number, as well as to form an additional anchoring in this area 4.

The athletic shoe according to the invention is especially well suited for use in field and track disciplines, where high speeds must be obtained for relatively short periods of time, thus, especially for sprint or short distances, for starts during jumping and vaulting competitions, such as broad-jumping, triple-jumping, high-jumping or pole-vaulting, or also for throwing the javelin. Especially in the case of these disciplines, it is important that the weight of the shoe is light, that the shoe has high resistance to distortion and effectively supports the foot in the area of the arch of the foot. In the case of normal sizes, athletic shoes having a weight of about 100 grams and below can be reached by means of the invention.

However, the invention also has considerable significance for shoes for medium and/or long distance running, because the previously insufficient support of the arch of the foot, in the case of longer stress, may result in irreparable damage to that part of the foot.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. An athletic shoe for track and field events of the type involving at least one of running and jumping, having a running sole made of a flexible plastic material continuing from the tip of the shoe to the heel and having profile projections that jut out of a running surface thereof, wherein the running sole, in an area of the longitudinal arch of the foot, is displaced toward the outside edge of the foot and is narrowed so that the running sole is located only under the part of the foot that engages the ground when stressed during running; the running sole is provided with a reinforcement plate that is adapted to the contour of the running sole, extends from the heel, along the narrowed part of the running sole, to at least approximately before the start of the ball of the foot and is fitted onto the running sole such that said reinforcement plate extends substantially to the outside edge of the running sole; and wherein the running sole, in the area of the longitudinal arch of the foot, is provided with a supporting wall that extends diagonally upwardly toward the inside of the foot and is shaped to substantially conform to the arch contour of the longitudinal arch of the foot.

2. An athletic shoe according to claim 1, wherein the reinforcement plate consists of a springy plastic that is hard in relationship to the flexible plastic of which the running sole is formed.

3. An athletic shoe according to claim 1, wherein the reinforcement plate is formed of a plastic mixed with fiber materials.

4. An athletic shoe according to claim 1, wherein the reinforcement plate consists of a plastic of a Shore hardness of at least 90 to 150, and the running sole consists of a plastic of a Shore hardness of about 50 to 80.

5. An athletic shoe according to claim 4, wherein the reinforcement plate is formed of a plastic mixed with fiber materials.

6. An athletic shoe according to claim 4, wherein the running sole and the reinforcement plate are formed of plastic comprised of one of polyurethane and polyethylene.

7. An athletic shoe according to claim 6, wherein the reinforcement plate, consisting of plastic, has a thickness of 0.8 to 1.5 mm.

8. An athletic shoe according to claim 6, wherein the running sole and the reinforcement plate have openings and projections that engage with one another.

9. An athletic shoe according to claim 8, wherein the reinforcement plate is an integrally molded-in part of the running sole.

10. An athletic shoe according to claim 8, wherein the flexibility of the running sole, in at least one of a foot joint area and a ball of the foot area, is increased by the provision of at least one bending zone in a forefoot area of the running sole formed by a corrugated band consisting of ripple elevations and ripple valleys.

11. An athletic shoe according to claim 2, wherein the running sole and the reinforcement plate have openings and projections that engage with one another.

12. An athletic shoe according to claim 11, wherein the running sole is glued to the prefabricated reinforcement plate.

13. An athletic shoe according to claim 2, wherein the running sole is glued to the prefabricated reinforcement plate.

14. An athletic shoe according to claim 2, wherein the reinforcement plate is an integrally molded-in part of the running sole.

15. An athletic shoe according to claim 1, wherein the supporting wall is reinforced by outer reinforcing ridges that, when viewed in a direction normal to the running surface of the running sole, extends approximately perpendicular to a longitudinal axis of the shoe.

16. An athletic shoe according to claim 15, wherein the reinforcing ridges have a length of 2 to 5 mm.

17. An athletic shoe according to claim 1, wherein the flexibility of the running sole, in at least one of a foot joint area and a ball of the foot area, is increased by the provision of at least one bending zone in a forefoot area of the running sole formed by a corrugated band consisting of ripple elevations and ripple valleys.

18. An athletic shoe according to claim 16, wherein the running sole is reinforced outside of said at least one bending zone by the provision of at least two insert parts that are made of a harder plastic than that of which the running sole is made, and which form bearing parts for at least one of profile projections formed on the insert parts and spike-shaped gripping elements.

19. An athletic shoe according to claim 18, wherein the insert pieces are of an L-shape having longer and shorter sides, the longer sides extending approximately perpendicular to a longitudinal axis of the shoe.

20. An athletic shoe according to claim 18, wherein the profile projections are provided on at least one of the running sole and said insert parts which are approximately of the same height, and said spike-shaped gripping parts project slightly above the profile projections.

21. An athletic shoe according to claim 1, wherein the reinforcement plate, at least in the area of the supporting wall, has an upwardly bent border extending in the longitudinal direction of the running sole.

22. An athletic shoe according to claim 21, wherein said upwardly bent border extends over the whole outside edge of the reinforcement plate.

23. An athletic shoe according to claim 22, wherein the running sole, in the area of the heel, has an upwardly extending border.

24. An athletic shoe according to claim 23, wherein the upwardly bent border of the reinforcing plate and the upwardly extending border of the running sole taper toward an edge so as to be very thin-walled and, in cross section, form a very acute angle.

25. An athletic shoe for track and field use, especially a running shoe for running and jumping competitions, having a running sole made of a flexible plastic material continuing from the tip of the shoe to the heel and having profile projections that jut out of a running surface thereof, wherein the running sole, in an area of the longitudinal arch of the foot, is displaced toward the outside edge of the foot and is narrowed so that the outside edge of the foot, stressed during running, is fully supported; the running sole is provided with a reinforcement plate extending from the heel, via the narrowed part of the sole, to at least approximately before the start of the ball of the foot and being fitted onto the running sole, and that the running sole, in the area of the longitudinal arch of the foot, forms a supporting wall that extends diagonally upwardly toward the inside of the foot and is substantially fitted to the arch contour of the longitudinal arch of the foot, wherein at least one of said reinforcement plate and at least one reinforcing part, provided in an area of the forefoot, are provided with openings through which profile projections molded onto the running sole extend.

26. An athletic shoe for track and field use, especially a running shoe for running and jumping competitions, having a running sole made of a flexible plastic material continuing from the tip of the shoe to the heel and having profile projections that jut out of a running surface thereof, wherein the running sole, in an area of the longitudinal arch of the foot, is displaced toward the outside edge of the foot and is narrowed so that the outside edge of the foot, stressed during running, is fully supported; the running sole is provided with a reinforcement plate extending from the heel, via the narrowed part of the sole, to at least approximately before the start of the ball of the foot and being fitted onto the running sole, and that the running sole, in the area of the longitudinal arch of the foot, forms a supporting wall that extends diagonally upwardly toward the inside of the foot and is substantially fitted to the arch contour of the longitudinal arch of the foot, wherein openings are provided in the reinforcement plate in an area of the longitudinal arch of the foot and profile projections on the running sole extend through said openings so as to be visible on the ground contacting side of the shoe, said projections forming at least one character such as a letter or number.

27. An athletic shoe according to claim 2, wherein openings are provided in the reinforcement plate in an area of the longitudinal arch of the foot and profile projections on the running sole extend through said openings so as to be visible on the ground contacting side of the shoe, said projections forming at least one character such as a letter or number.

* * * * *